US006533117B2

(12) United States Patent
Lundstrom et al.

(10) Patent No.: US 6,533,117 B2
(45) **Date of Patent: *Mar. 18, 2003**

(54) CANDLE PACKAGING SYSTEM AND METHOD OF PRODUCING SAME

(75) Inventors: Steven Lundstrom, Irvine, CA (US); Tina Rocca-Lundstrom, Irvine, CA (US)

(73) Assignee: Aroma Naturals, Inc., Irvine, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/473,040

(22) Filed: Dec. 28, 1999

(65) Prior Publication Data

US 2002/0088204 A1 Jul. 11, 2002

(51) Int. Cl.[7] ..... B65D 85/20; B65D 25/54; B65D 81/02

(52) U.S. Cl. ..... 206/446; 206/588; 206/776; 229/162

(58) Field of Search ..... 206/446, 775, 206/776, 779, 588, 592; 229/162; 431/289–295; D9/418

(56) References Cited

U.S. PATENT DOCUMENTS

| | | | | | |
|---|---|---|---|---|---|
| 2,325,224 | A | * | 7/1943 | Bryant, Sr. | 206/446 |
| 3,077,981 | A | * | 2/1963 | Gaspard | 206/446 |
| 3,286,492 | A | * | 11/1966 | Frazier, Jr. | 431/291 |
| 3,314,532 | A | * | 4/1967 | Henry | 206/446 |
| 3,631,970 | A | * | 1/1972 | Trauschke | 206/779 |
| 4,240,783 | A | * | 12/1980 | Nevin et al. | 431/253 |
| 4,858,756 | A | * | 8/1989 | Herrin et al. | 229/162 |
| 5,582,293 | A | * | 12/1996 | Kay | 206/775 |
| D424,430 | S | * | 5/2000 | Seidler | D9/418 |
| D424,932 | S | * | 5/2000 | Seidler | D9/418 |
| D429,148 | S | * | 8/2000 | Seidler | D9/418 |

FOREIGN PATENT DOCUMENTS

| | | | | |
|---|---|---|---|---|
| EP | 0 354 249 | * | 2/1990 | 206/446 |

* cited by examiner

*Primary Examiner*—Bryon P. Gehman
(74) *Attorney, Agent, or Firm*—Thomas N. Neiman; James M. Leas

(57) ABSTRACT

The present invention is directed to a candle packaging system that is comprised of a three part assembly. The first part is a clear box having a slightly frosted appearance. The candle packaging apparatus has a separate internal top and bottom cap units that are designed to be placed on top of and at the base of the candle in order to protect the top and bottom edges of the candle. The top and bottom caps are also constructed of a clear, frosted material. The third part of the construction is a printed insert that is designed to highlight the purpose and design of the candle itself. The box is designed to provide ease of access to allow the prospective buyer to smell the aroma of the candle and, at the same time, provide protection and keep the candle clean and fresh. A method of producing the candle packaging system is also disclosed.

38 Claims, 3 Drawing Sheets

CANDLE PACKAGING SYSTEM AND METHOD OF PRODUCING SAME

BACKGROUND OF THE INVENTION

This invention pertains to packaging, and, in particular, to a candle packaging system and method of producing same that will provide a unique package that will protect the candle being marketed from being damaged, maintain its freshness and, at the same time, provide a very unique marketing design. A method of producing the candle packaging system is also disclosed.

There are a great number of packages on the market today. Some of these units are simple boxes that surround the candle and some are very complex. Additionally, many candles come in containers that are not sealed in any way and show the entire candle to the buying public. However, one of the problems with that approach is that many candle will get damaged in transit or in stocking the store's shelves. Additionally, those scented type candles tend to lose their scent over time. Another way of packaging candle is to shrink wrap them, but this does not allow the public access to smell the candle. It is the object of this invention to teach a packaging system for candles that is designed to protect the candle, promote its freshness and, at the same time, effectively promote the candle by showing the candle in an attractive package.

Clearly, it is desirable for a package system of this type to be lightweight and easily handled. At the same time, the system should be easy to produce and, at the same time, be very flexible. An object of this invention is to provide a package system that has an ease of manufacture and ease of assembly. It is another object of this invention to set forth an improved packaging system for candles and a method of producing a packaging system for candles which avoids the disadvantages, limitations, above-recited, obtained from candle packaging system.

SUMMARY OF THE INVENTION

Particularly, it is the object of this invention to set forth a candle packaging system, for use in providing a secure and attractive combination unit that will ensure the integrity of the candle, maintain the freshness of the candle and present a pleasing appearance for the consumer, comprising an outer box unit for providing overall protection for the candle; at least one inner candle protective unit for permitting said candle to fit snugly within said inner protective unit, said candle and said inner protective units are designed to fit within said outer box unit; and a printed insert piece to be positioned around said candle within said outer unit for providing a printable area around said candle for advertising and informational purposes.

It is also the object of this invention a candle packaging system, for use in providing a secure and attractive combination unit that will ensure the integrity of the candle, maintain the freshness of the candle and present a pleasing appearance to the consumer, comprising in combination an outer container for providing overall protection for the candle, said outer container having at least one candle cap for permitting said candle to fit snugly within said candle cap, said candle and said candle caps are designed to fit within said outer container, and a printed insert piece to be positioned around said candle within said container for providing a printable area around said candle for advertising and informational purposes.

Finally it is the object of this invention to teach a method of producing a candle packaging system, for use in providing a secure and attractive combination unit that integrity of the candle, maintain the freshness of the candle and present a pleasing appearance to the consumer, comprising the steps of steps of providing at least one sheet of material for providing a box for the packaging system for candles; cutting the layer of material as necessary for the packaging system for candles; folding the layer of material as necessary to form the box; providing at least one end cap to fit snugly on said candle; providing at least one sheet of material for being inserted into said box; cutting said sheet of material as necessary for the specific purposes; printing the information and design as necessary on the sheet of material; folding said sheet of material as necessary for the specific purposes; and inserting the material with said box to form the finished packaging system for candles.

BRIEF DESCRIPTION OF THE DRAWINGS

Further objects and features of this invention will become more apparent by reference to the following description taken in conjunction with the accompanying figure, in which.

DETAILED DESCRIPTION OF THE PREFERRED EMBODIMENT

Figure 1:
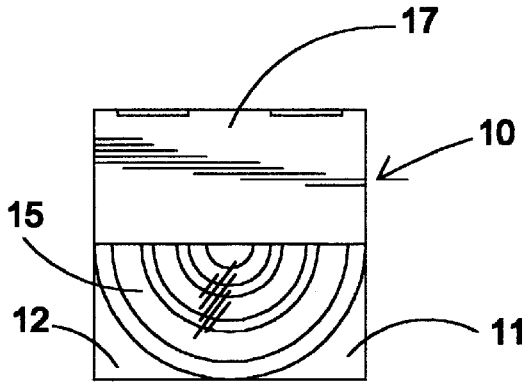
FIG. 1 is a top plan view of a novel packaging system for candles.
Figure 2:
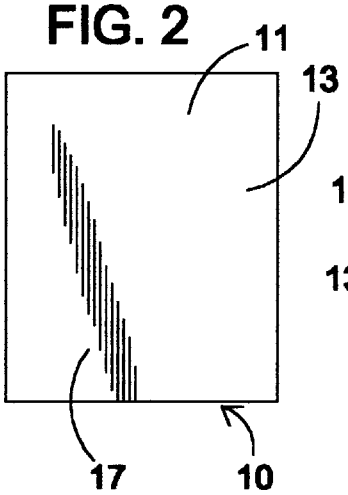
FIG. 2 is a rear elevational view thereof.
Figure 3:
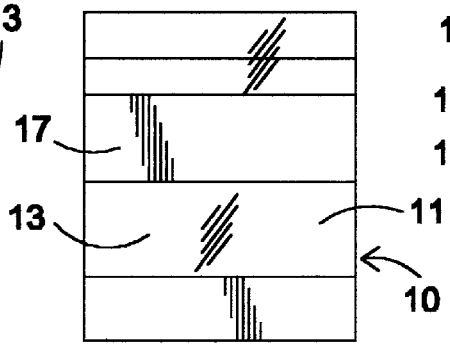
FIG. 3 is a front elevational view thereof.
Figure 4:
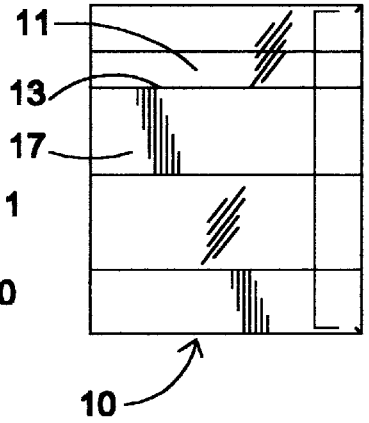
FIG. 4 is a side elevational view thereof.
Figure 5:
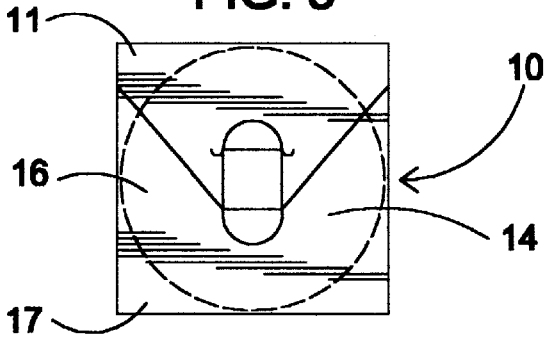
FIG. 5 is a bottom plan view thereof.
Figure 6:
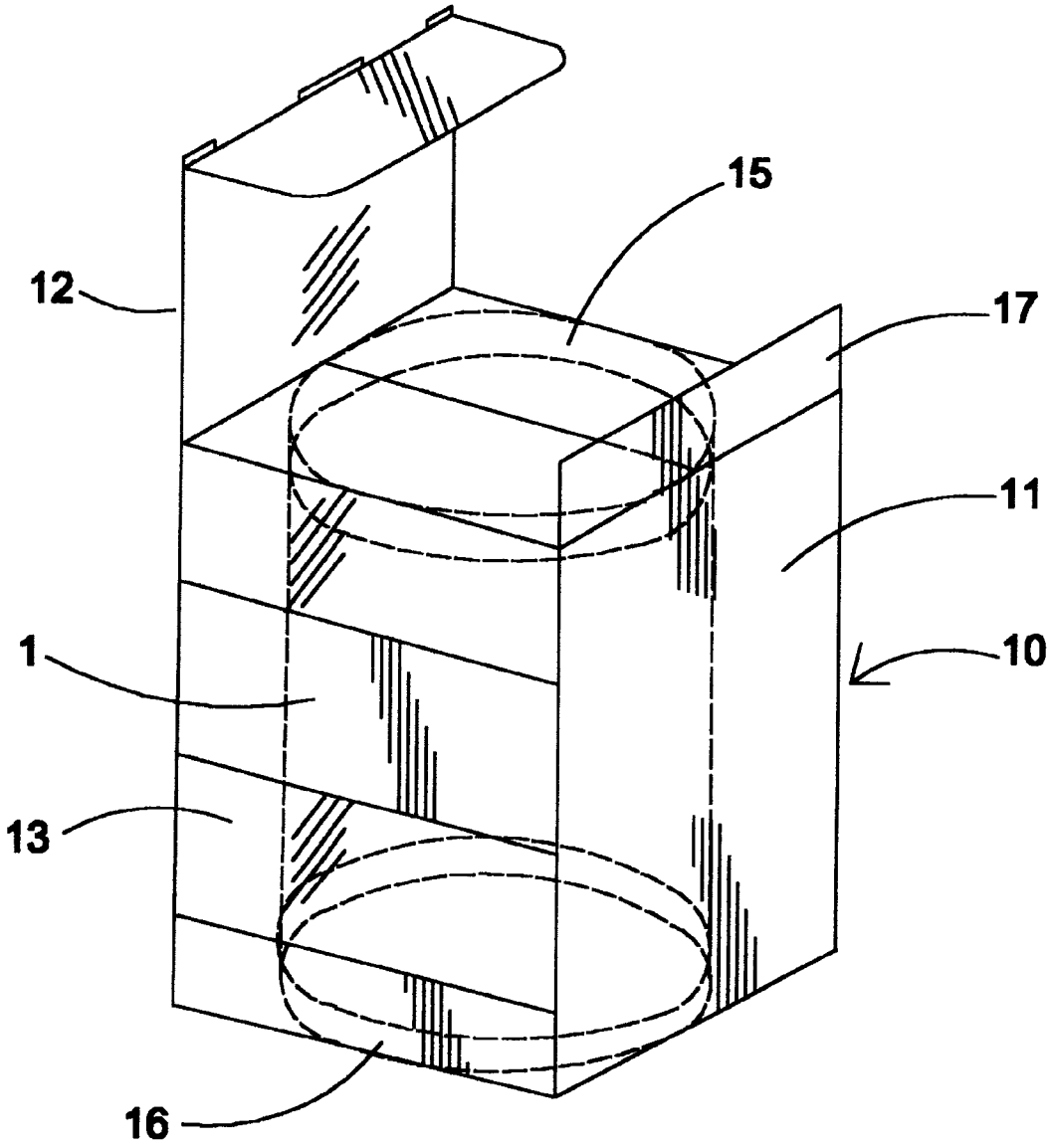
FIG. 6 is a perspective view of the packaging system with the top panel opened.
Figure 7:
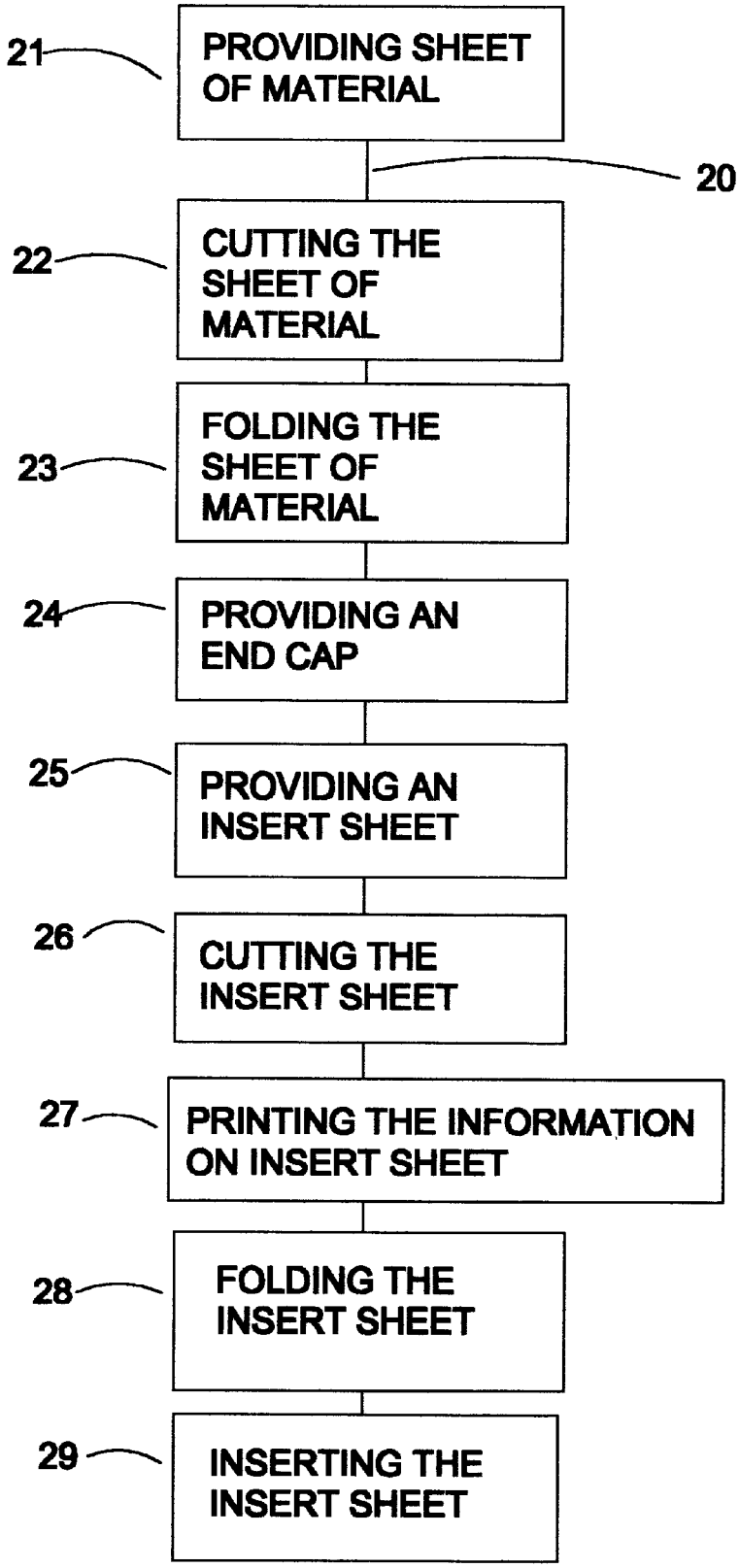
FIG. 7 is a block diagram of the method of producing the packaging system for candles.

As shown in the figures, the novel packaging system for candles 10 is comprised of a box 11 made of a clear materials, such as plastic. The finished product will have a frosted finish for the purpose of providing an attractive product to the public. The box 11 is the first element of the packaging system 10. The box has a top panel 12, sides 13, and a base 14. All sides of the box are a clear plastic material that are finished with a frosted appearance. The second element of the packaging system for candles 10 are the candle caps or end caps the top cap 15 and the base cap 16. They are also manufactured of a plastic material, are clear, and have a finished frosted appearance. The are designed to fit snugly on the top end surface and the bottom end surface of the candle 1. They are designed to protect the top and bottom edges of the candle 1 and still allow the candle to show through the box 11. The third element is the printed insert 17. They are done in a finished design that will allow the candle to be merchandised from both the standard upright position and also lying on its side and, at the same time, would still allow the candle to be seen as a candle. The insert can be imprinted on any of its sides and both information and design art can be printed thereon.

The novel method 20 disclosed in the application includes the steps of providing at least one sheet of material for providing a box for the packaging system for candles 21; cutting the layer of material as necessary for the packaging system for candles 22; folding the layer of material as necessary to form the box 23; providing at least one end cap to fit snugly on said candle 24; providing at least one sheet of material for being inserted into said box 25; cutting said sheet of material as necessary for the specific purposes 26;

printing the information and design as necessary on the sheet of material 27; folding said sheet of material as necessary for the specific purposes 28; and inserting the material with said box to form the finished packaging system for candles 29. This method results in a unique packaging system for candles.

The use of the packaging system for candles and the method accomplishes a number of goals. It provides a unique gift box that is easier to wrap and presents an exquisite gift. The sturdy box and top and base caps protects valuable aromatherapy candle inventories from denting and bruising. The packaging provides the candle with a high visibility and the opening of the top panel allows the customer to smell the product without damaging it. The aroma and color of the candle are enhanced and preserved for an extended period of time. The packaging system for candles also protects the retail shelving from wax and, at the same time, protects the candle from dust. The design allows stacking and maximizes shelving space and minimizes the effort necessary for maintaining the shelving display.

While we have described our invention in connection with specific embodiments thereof, it is clearly to be understood that this is done only by way of example and not as a limitation to the scope of our invention as set forth in the objects thereof and in the appended claims.

We claim:

1. A candle packaging system, comprising:

a candle comprising a top end and a bottom end;

an outer box unit for providing overall protection for said candle;

a two-piece candle protective unit comprising a top protective cap and a bottom protective cap, wherein said candle fits between said two pieces of said two-piece candle protective unit, wherein said candle and said two-piece candle protective unit fit within said outer box unit and wherein said top protective cap entirely covers said top protective, of the candle.

2. A candle packaging system, according to claim 1, wherein:

said outer box unit comprises a flexible housing.

3. A candle packaging system, according to claim 2, wherein:

said flexible housing comprises a unit constructed of plastic material;

said plastic material comprises a transparent unit; and said transparent unit having a frosted appearance finish.

4. A candle packaging system, according to claim 1, wherein said top protective cap is designed to fit over said top end and said bottom protective cap is designed to fit over said bottom end, said top protective cap and said bottom protective cap for maintaining said candle in its original condition.

5. A candle packaging system, according to claim 1, further comprising a printed insert piece within said outer box unit.

6. A candle packaging system, according to claim 5, wherein said printed insert piece comprises cellulose material or plastic material.

7. A candle packaging system as recited in claim 5, wherein said printed insert piece is externally visible for advertising or informational purposes.

8. A candle packaging system as recited in claim 7, wherein said printed insert piece fits around said candle.

9. A candle packaging system as recited in claim 1, wherein said system is for providing a secure and attractive unit that will ensure the integrity of said candle, maintain the freshness of said candle, and present a pleasing appearance for the consumer.

10. The package as recited in claim 1, wherein said outer box unit comprises a transparent material or comprises a transparent material having a frosted appearance.

11. The package as recited in claim 1, wherein said candle comprises a top end and a bottom end, wherein said two-piece candle protective unit comprises a first protective cap designed to fit over said top end and a second protective cap designed to fit over said bottom end for maintaining said candle in its original condition.

12. The package as recited in claim 11, wherein one said protective cap comprises a rectangular surface matching inside dimensions of said outer box unit.

13. The package as recited in claim 12, wherein one said protective cap defines a plane extending on said top end or said bottom end and said rectangular surface extends along said plane.

14. The package as recited in claim 11, wherein said protective caps each comprise a protective cap surface matching inside dimensions of said outer box unit.

15. The package as recited in claim 14, wherein said first protective cap defines a plane extending on said first end and said protective cap surface extends along said plane.

16. The package as recited in claim 15, wherein said outer box unit comprises a rectangular shape, wherein said first protective end cap comprises a rectangular shape fitting snugly within said outer box unit.

17. A candle packaging system, comprising:

a candle having a first end surface and a second end surface;

an outer container having an openable top, said outer container for providing overall protection for said candle;

a two-piece inner protective unit comprising a first candle cap and a second candle cap, said first candle cap on said first end surface and said second candle cap on said second end surface, said candle fitting between said candle caps, wherein said candle and said candle caps fit within said outer container and wherein said first candle cap is adjacent said openable top and wherein said first candle cap entirely covers said first end surface of the cap.

18. A candle packaging system as recited in claim 17, wherein said system is for providing a secure and attractive unit that will ensure the integrity of said candle, maintain the freshness of said candle, and present a pleasing appearance for the consumer.

19. A candle packaging system as recited in claim 17, further comprising a printed insert piece within said container visible from outside said outer container.

20. The package as recited in claim 17, wherein said candle caps each comprise a candle cap surface matching inside dimensions of said outer container.

21. The package as recited in claim 20, wherein said first candle cap defines a plane extending on said first end surface and said candle cap surface extends along said plane.

22. A package for a candle, comprising:

a candle and a transparent box, said candle comprising a top end having a top end surface and a top edge, said candle further comprising a bottom end having a bottom end surface and a bottom edge, said box for holding said candle, said box having an inside dimension substantially larger than an outside dimension of said candle when said dimensions are measured in a plane defined by said top or said bottom edge; and a two-piece protective unit comprising a first end cap and a second end cap, said first end cap extending on said top surface holding said top end in a position within said box and a second end cap extending on said bottom end surface holding said bottom end in a position within said box, wherein said end cap protects said top edge, said second end cap protects said bottom edge, and wherein said candle is visible through said transparent box from outside said box.

23. The package as recited in claim 22, wherein said transparent box comprises a clear plastic material.

24. The package as recited in claim 23, wherein said clear plastic material is cut and folded.

25. The package as recited in claim 23, wherein said material comprises a frosted appearance.

26. The package as recited in claim 22, wherein said box comprises a top panel, four side panels, and a base panel.

27. The package as recited in claim 22, wherein said first end cap and said second end cap comprise a clear material.

28. The package as recited in claim 22, wherein said first end cap and said second end cap have a dimension slightly larger than a dimension of said candle.

29. The package as recited in claim 22, wherein said first end cap and said second end cap provide said candle centered within said box.

30. The package as recited in claim 22, wherein said first end cap and said second end cap fit snugly on ends of said candle.

31. The package as recited in claim 22, wherein said candle fits snugly between said first end cap and said second end cap.

32. The package as recited in claim 22, wherein said first end cap and said second end cap comprise a clear material and wherein said first end cap and said second end cap retain said candle there between centered in said box and visible through said clear material.

33. The package as recited in claim 22, further comprising a printed insert within said box, wherein printing on said printed insert is visible through said transparent box from outside said box.

34. The package as recited in claim 33, wherein said printed insert extends along a side of said box.

35. The package as recited in claim 33, wherein said printed insert extends around said candle in said box.

36. The package as recited in claim 33, wherein said insert comprises information about said candle.

37. The package as recited in claim 33, wherein said insert comprises cellulose material or plastic.

38. The package as recited in claim 33, wherein said box comprises a clear plastic material, said inner protective unit further comprises a second end unit, and wherein said candle is held snugly between said first end unit and said second end unit.

* * * * *

UNITED STATES PATENT AND TRADEMARK OFFICE

CERTIFICATE OF CORRECTION

PATENT NO. : 6,533,117 B2 
DATED : March 18, 2003
INVENTOR(S) : Thomas M. Dionisio It is certified that error appears in the above-identified patent and that said Letters Patent is hereby corrected as shown below:

Title page,
Item [75], Inventor, please delete "Inventors: Steven Lundstrom, Irvine, CA (US);" and "Tina Rocca-Lundstrom, Irvine CA (US)" as inventors and add
-- Inventor: Thomas M. Dionisio, Mission Viejo, CA (US) -- as the sole inventor Signed and Sealed this Seventeenth Day of February, 2004

JON W. DUDAS
*Acting Director of the United States Patent and Trademark Office*